US005642859A

United States Patent [19]

Ackroyd

[11] Patent Number: 5,642,859

[45] Date of Patent: Jul. 1, 1997

[54] TEMPERATURE-SENSITIVE SAFETY VALVE ASSEMBLY

[75] Inventor: Rand H. Ackroyd, Methuen, Mass.

[73] Assignee: Watts Investment Company, Wilmington, Del.

[21] Appl. No.: 633,902

[22] Filed: Apr. 17, 1996

[51] Int. Cl.[6] ..... G05D 23/12

[52] U.S. Cl. ..... 236/93 B; 236/100; 236/DIG. 2

[58] Field of Search ..... 236/93 A, 93 B, 236/99 J, 99 K, 100, DIG. 2

[56] References Cited

U.S. PATENT DOCUMENTS

| | | | |
|---|---|---|---|
| 2,902,222 | 9/1959 | Noakes | 236/93 A |
| 3,038,664 | 6/1962 | Kingsley | 236/93 |
| 3,263,926 | 8/1966 | Couffer et al. | 236/93 |
| 4,180,208 | 12/1979 | Obermaier | 236/93 |
| 4,981,261 | 1/1991 | Bergmann et al. | 236/93 |
| 5,024,378 | 6/1991 | Bergmann et al. | 236/93 |
| 5,294,046 | 3/1994 | Fishman | 236/345 |
| 5,381,951 | 1/1995 | Michel | 236/34.5 |

FOREIGN PATENT DOCUMENTS

| | | | |
|---|---|---|---|
| 3520146 | 12/1986 | Germany | 236/93 B |

*Primary Examiner*—William E. Tapolcai
*Attorney, Agent, or Firm*—Fish & Richardson P.C.

[57] ABSTRACT

A temperature sensitive safety valve assembly includes a housing for mounting at a faucet outlet and a safety valve element consisting of a rigid cap and an elastic bellows containing a body of temperature sensitive material. Below a predetermined temperature, the bellows has a first condition permitting flow of water towards the faucet outlet. Above the predetermined temperature, the bellows has a second condition restricting flow of water. The bellows also has a third condition, actuated by loss of at least a portion of the body of temperature sensitive material, in which a seal surface of the cap engages with an opposed seat surface of the housing to restrict flow of water towards the faucet outlet.

4 Claims, 3 Drawing Sheets

TEMPERATURE-SENSITIVE SAFETY VALVE ASSEMBLY

BACKGROUND OF THE INVENTION

The invention relates to a temperature-sensitive, flow-limiting valves.

Plumbing fixtures, such as faucets or shower heads, are often equipped with temperature-sensitive, flow-limiting valves to resist unexpected surges of scalding hot water that can often result is injury to young children and others. Typically, the water faucet is provided with an anti-scalding adapter to restrict flow of hot water when the water temperature reaches scalding and potentially harmful levels.

SUMMARY OF THE INVENTION

According to the invention, a temperature sensitive safety valve assembly for use at a faucet outlet comprises: a housing adapted to be mounted at a faucet outlet and having an inner surface defining an axial bore for flow of water towards the faucet outlet; a first retainer mounted to the housing in an upstream region and a second retainer mounted to the housing in a downstream region; a safety valve element disposed within the axial bore, generally between the first retainer and the second retainer, the safety valve element comprising an elastic bellows mounted to a rigid cap, the bellows and cap together defining a volume, the volume containing a body of temperature sensitive material; and a spring mounted between the first retainer and the safety valve element and bearing upon the cap to urge the safety valve element towards engagement of the bellow upon the second retainer; the rigid cap defining a seal surface and the housing further defining an opposed seat surface. The bellows, at temperatures below a predetermined temperature, has a first condition in which the body of the temperature sensitive material contained within the volume allows external surfaces of the bellows to remain spaced from contact with surrounding surfaces of the housing, thereby to permit flow of water through the housing, towards the faucet outlet, the bellows, in the first condition, maintaining the seal surface of the cap spaced from sealing engagement with the seat surface of the housing; the bellows, at temperatures above the predetermined temperature, has a second condition in which the body of the temperature sensitive material contained within the volume urges the external surfaces of the bellows into contact with surrounding surfaces of the housing, thereby to restrict flow of water through the housing, towards the faucet outlet, the bellows, in the second condition, maintaining the seal surface of the cap spaced from sealing engagement with the seat surface of the housing; and the bellows has a third condition in which loss of at least a portion of the body of the temperature sensitive material from within the volume allows the spring to urge the seal surface of the cap into engagement with the seat surface of the housing, thereby to restrict flow of water through the housing, towards the faucet outlet.

In preferred embodiments, the invention may include one or more of the following features. In the first condition of the bellows, the body of the temperature sensitive material is substantially solid, and, in the second condition of the bellows, the body of the temperature sensitive material is substantially liquid. The predetermined temperature is about 110° F. The temperature sensitive material is wax.

Other features and advantages of the invention will become apparent from the following detailed description, and from the claims.

DESCRIPTION OF THE PREFERRED EMBODIMENTS

Figure 1:
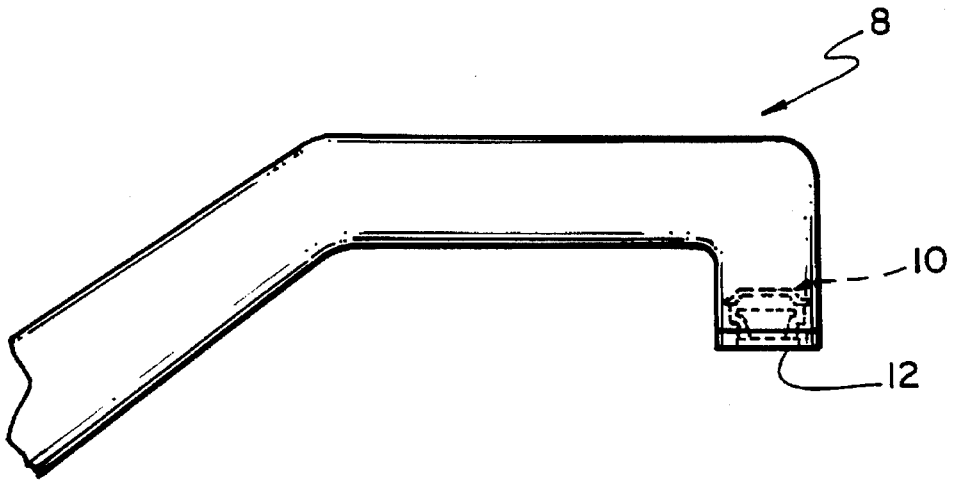
FIG. 1 is a diagrammatic view of a faucet equipped with a temperature sensitive safety valve assembly of the invention.

Referring to FIG. 1, a faucet 8 is equipped with a temperature-sensitive safety valve assembly 10 of the invention positioned at the faucet outlet 12.

Figure 2:
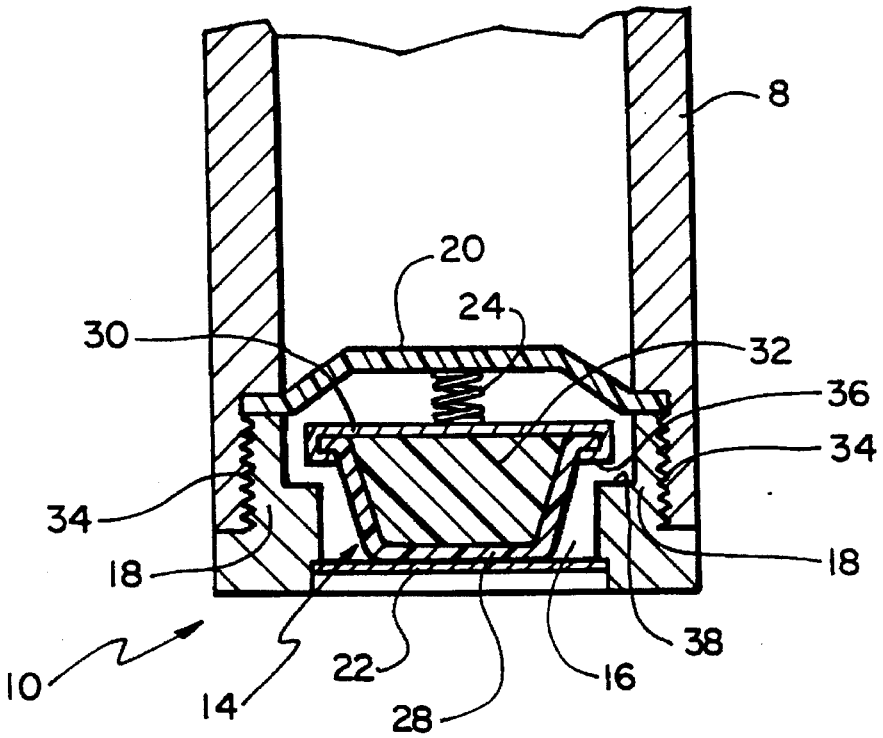
FIG. 2 is a side section view of the temperature sensitive safety valve assembly of FIG. 1 in a faucet outlet.

Referring also to FIG. 2, a safety valve assembly 10 consists of a safety valve element 14 disposed within an axial bore 16 defined by a housing 18. The valve element 14 is retained within the bore between a first retainer 20 and a second retainer 22. A spring 24 urges the valve element 14 towards engagement upon the second retainer, which is a mesh screen provided for filtering sediment or other foreign material from the water. The valve element 14 consists of a bellows or bladder 28, formed of rubber or other suitable elastic material, and a rigid, e.g. metal, cap 30, with a body 32 of temperature sensitive material, e.g. wax, contained with a volume defined by the bellows and cap.

The safety valve assembly 10 is attached at the faucet outlet 12, e.g. by threaded interengagement 34 of threads on the outer surface of the housing 18 and with corresponding threads on the inner surface of the faucet 8 at the outlet 12.

The rigid cap 30 of the safety valve element also defines a seal surface 36, and the housing 18 defines an opposed seat surface 38, which will be described more fully below.

Figure 3:
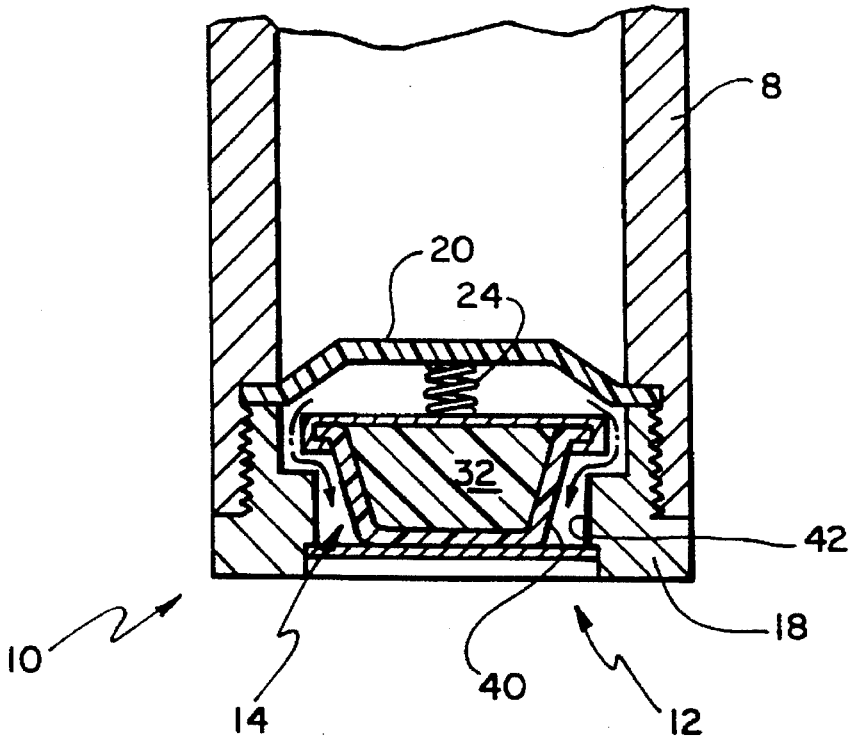
FIG. 3 is another side section view of the temperature sensitive safety valve assembly of FIG. 2 in a faucet outlet, with the water temperature below a predetermined level.

Referring to FIG. 3, under conditions of normal water temperature, i.e. while the temperature of water flowing through the faucet outlet 12 is less than a predetermined temperature selected to prevent injury, e.g. 110° F., the temperature-sensitive material 32 of the body remains in solid, relatively reduced volume form, with the bellows 28 maintaining a shape in which its outer surface 40 is generally spaced from engagement with surrounding wall surface 42 of the housing 18, to allow the flow of water (indicated by the arrows) through the space between the cap 30 and seat surface 38 of the housing, around the bellows portion of the safety valve element, and through the faucet outlet 12.

Figure 4:
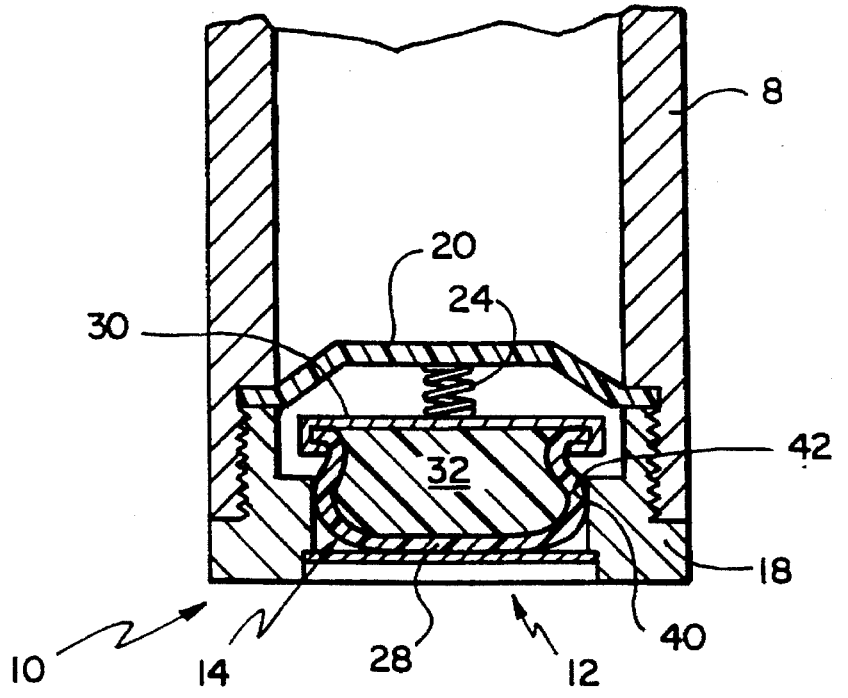
FIG. 4 is a similar view of the temperature sensitive safety valve assembly of FIG. 2 in a faucet outlet, with the water temperature above the predetermined level.

Referring next to FIG. 4, if the temperature of the water at the faucet outlet 12 exceeds the predetermined temperature, e.g. 110° F., the temperature sensitive material, i.e. wax 32, expands as it melts into a liquid state. The liquid, expanded state of the temperature sensitive material allows the wall of the bellows 28 to swell outwardly, bringing the bellows wall surface 40 into sealing engagement with the surrounding wall surfaces 42 of the housing 18, thereby restricting or blocking flow of water towards the faucet outlet 12.

When the temperature at the outlet 12 once more drops below the preselected temperature, e.g. when the hot water is shut off or the cold water is turned on, the temperature-sensitive material 32 once again contracts as it returns to solid form, thus allowing the walls 40 of the bellows 28 to retract from engagement with the surrounding walls 42 of the housing 28, returning, e.g. to the shape shown in FIG. 3, and permitting flow of water to resume.

Figure 5:
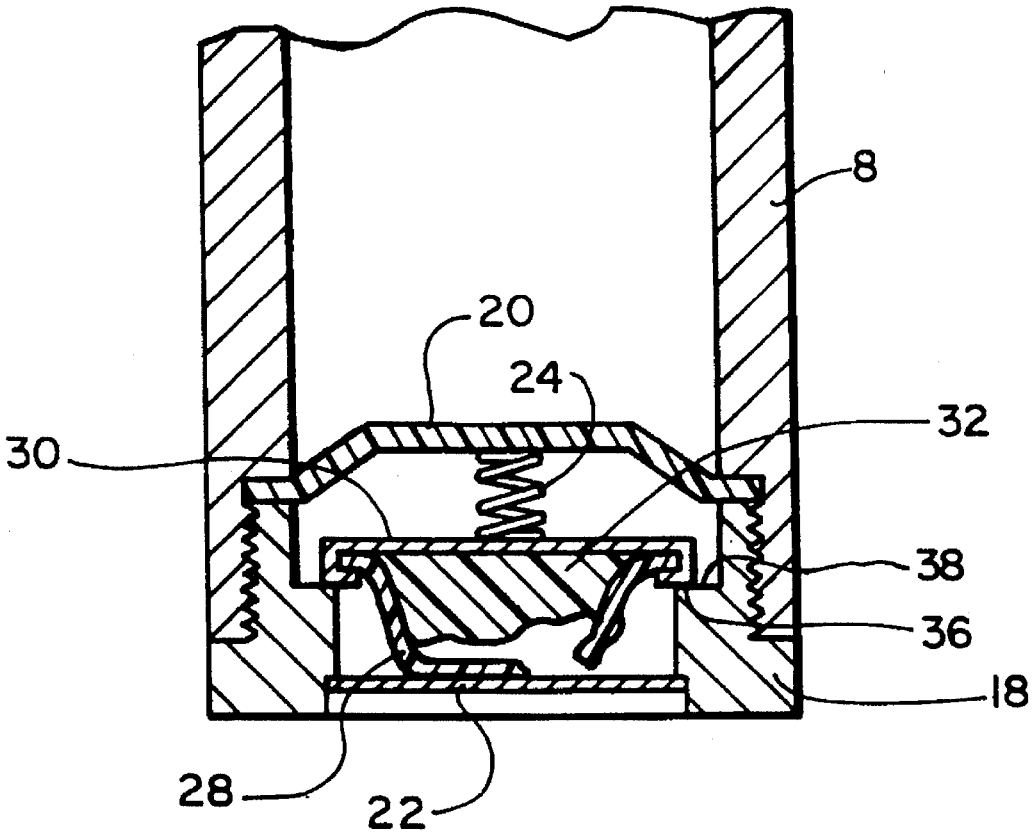
FIG. 5 is a similar side view of the temperature sensitive safety valve assembly of FIG. 2 in a faucet outlet, with the temperature sensitive safety valve in fail-safe mode.

Referring now to FIG. 5, the safety valve assembly 10 of the invention also provides a further "fail-safe" mode, which is actuated upon loss of the temperature-sensitive material 32 from the body of the safety valve element 14, e.g. upon rupture of the bellows 28 or loss of the seal between the bellows 28 and cap 30, e.g. due to corrosion. If this situation occurs, the biasing force of the spring 24, acting upon the cap 30, urges the cap towards the outlet 12, until the sealing surface 36 of the cap 30 engages, in sealing relationship, upon the opposed seat surface 38 of the housing 18, thereby resisting or blocking flow of water towards the faucet outlet 12.

Further flow of water from the faucet is prevented or restricted until the safety valve assembly 10 is removed, or replaced.

Other embodiments are within the claims.

For example, although the invention has been described for use in a hot water faucet, it is appreciated that the concept is applicable to other water outlets including shower heads.

What is claimed is:

1. A temperature sensitive safety valve assembly for use at a faucet outlet, said safety valve assembly comprising:

a housing adapted to be mounted at a faucet outlet and having an inner surface defining an axial bore for flow of water towards the faucet outlet;

a first retainer mounted to said housing in an upstream region and a second retainer mounted to said housing in a downstream region;

a safety valve element disposed within said axial bore, generally between said first retainer and said second retainer, said safety valve element comprising an elastic bellows mounted to a rigid cap, said bellows and cap together defining a volume, said volume containing a body of temperature sensitive material; and a spring mounted between said first retainer and said safety valve element and bearing upon said cap to urge said safety valve element towards engagement of said bellow upon said second retainer;

said rigid cap defining a seal surface and said housing further defining an opposed seat surface;

said bellows, at temperatures below a predetermined temperature, having a first condition in which said body of said temperature sensitive material contained within said volume allows external surfaces of said bellows to remain spaced from contact with surrounding surfaces of said housing, thereby to permit flow of water through said housing, towards said faucet outlet, said bellows, in said first condition, maintaining said seal surface of said cap spaced from sealing engagement with said seat surface of said housing;

said bellows, at temperatures above the predetermined temperature, having a second condition in which said body of said temperature sensitive material contained within said volume urges said external surfaces of said bellows into contact with surrounding surfaces of said housing, thereby to restrict flow of water through said housing, towards said faucet outlet, said bellows, in said second condition, maintaining said seal surface of said cap spaced from sealing engagement with said seat surface of said housing, and said bellows having a third condition in which loss of at least a portion of said body of said temperature sensitive material from within said volume allows said spring to urge said seal surface of said cap into engagement with said seat surface of said housing, thereby to restrict flow of water through said housing, towards said faucet outlet.

2. The temperature safety valve assembly of claim 1, wherein, in said first condition of said bellows, said body of said temperature sensitive material is substantially solid, and, in said second condition of said bellows, said body of said temperature sensitive material is substantially liquid.

3. The temperature safety valve assembly of claim 1, wherein said predetermined temperature is about 110° F.

4. The temperature safety valve assembly of claim 1, wherein said temperature sensitive material is wax.

* * * * *